US007454996B2

(12) United States Patent
Hsu

(10) Patent No.: US 7,454,996 B2
(45) Date of Patent: Nov. 25, 2008

(54) SCREW NAIL MAGAZINE FOR ELECTRIC-POWERED SCREWDRIVER

(75) Inventor: Ming-Hung Hsu, Taichung (TW)

(73) Assignee: Mobiletron Electronics Co., Ltd., Taichung Hsienc (TW)

( * ) Notice: Subject to any disclaimer, the term of this patent is extended or adjusted under 35 U.S.C. 154(b) by 380 days.

(21) Appl. No.: 11/430,910

(22) Filed: May 10, 2006

(65) Prior Publication Data

US 2007/0261518 A1 Nov. 15, 2007

(51) Int. Cl.
*B25B 23/04* (2006.01)
*B25B 23/00* (2006.01)

(52) U.S. Cl. ..... 81/57.37; 81/434

(58) Field of Classification Search ..... 81/57.37, 81/434, 433, 54, 429, 52, 451; 227/135, 227/136, 139

See application file for complete search history.

(56) References Cited

U.S. PATENT DOCUMENTS 5,473,965 A * 12/1995 Chen ..... 81/434
5,988,026 A * 11/1999 Reckelhoff et al. ..... 81/434
6,701,811 B1 * 3/2004 Chang et al. ..... 81/434

* cited by examiner

*Primary Examiner*—Hadi Shakeri
(74) *Attorney, Agent, or Firm*—Bacon & Thomas, PLLC

(57) ABSTRACT

A screw nail magazine for an electric screwdriver includes a fixed holder member, a movable holder member reciprocally moveably mounted inside the fixed holder member, a positioning member fastened to the moveable holder member, and a nailing depth adjustment device. The nailing depth adjustment device has a control member pivotally mounted in the fixed holder member for rotation by a user, a driven member fixedly connected to the control member and located inside the fixed holder member, a slider coupled to the driven member and movable along a fixed path by the driven member actuated by the control member, and a stop block mounted on the slider and stopped at the positioning member for limiting the moving stroke of the moveable holder member inside the fixed holder member.

2 Claims, 8 Drawing Sheets

SCREW NAIL MAGAZINE FOR ELECTRIC-POWERED SCREWDRIVER

BACKGROUND OF THE INVENTION

1. Field of the Invention

The present invention relates to an accessory for a power hand tool and more particularly, to a screw nail magazine for an electric screwdriver.

2. Description of the Related Art

A conventional screw nail magazine A, as shown in FIGS. 1 and 2, comprises a fixed holder member A1, a movable holder member A2, a spring member A3, a positioning member A4, a belt track A5, a belt drive member A6, and a nailing depth adjustment device A7. The fixed holder member A1 is adapted to be affixed to the housing of an electric screwdriver. The movable holder member A2 is mounted in the fixed holder member A1 and movable backwards and forwards on the fixed holder member A1 in a predetermined path. The spring member A3 is set between the fixed holder member A1 and the movable holder member A2. The positioning member A4 is mounted on the movable holder member A2, having a contact portion A41 for stopping against the work surface where a screw nail is to be driven in or turned out. The belt track A5 is mounted on the movable holder member A2 to support a belt B that carries a row of screw nails and to provide a moving path for the belt B. The belt drive member A6 is mounted on the movable holder member A2 and adapted to move the belt B in the path provided by the belt track A5. The nailing depth adjustment device A7 is mounted on the fixed holder member A1 and adapted to control the nailing depth of the electric nailing tool. When in use, the belt B is mounted on the belt track A5 and extending over the belt drive member A6, and then the fixed holder member A1 of the screw nail magazine A is fastened to the electric screwdriver, keeping the driving blade of the electric screwdriver located inside the movable holder member A2 at a position relative to the inner side of the belt B. During working, the pressed portion A41 of the positioning member A4 is pressed on the work surface with one screw nail of the belt B aimed at the selection location at the work surface, and then a force is applied to the electric screwdriver against the work surface. At this time, the movable holder member A2 and the positioning member A4 are moved into the inside of the fixed holder member A1, enabling the driving blade of the electric screwdriver to stop at the respective screw nail against the work surface. When starting the electric screwdriver at this time, the respective screw nail is driven into the work surface.

The nailing depth adjustment device A7 limits the depth of the retraction of the movable holder member A2 in the fixed holder member A1, thereby effectively controlling the nailing depth of the electric screwdriver. The nailing depth adjustment device A7 comprises a stop block A71 and a lock screw A72. The stop block A71 is provided in the fixed holder member A1, having a beveled stop face A711. The lock screw A72 has a head A721 and a threaded shank A722. The threaded shank A722 is inserted through an elongated slot A11 on the fixed holder member A1 and connected to the stop block A71 in the fixed holder member A1. When fastened up the lock screw A72 after having moved the lock screw A72 along the elongated slot A11 to the selected position, the stop block A71 is locked to the fixed holder member A1 at the desired location. When the positioning member A4 is moved with the movable holder member A2 backwards to the inside of the fixed holder member A1, the beveled stop face A711 of the stop block A71 stops a complementary beveled face A42 at the positioning member A4, thereby limiting the nailing depth. When loosened the lock screw A72, the lock screw A72 can be moved along the elongated slot All to change the position of the stop block A71 in the fixed holder member A1, thereby adjusting the nailing depth of the electric screwdriver.

However, when loosening the lock screw A72, the lock screw A72 may be disconnected from the stop block A71. In this case, the user must remove the screw nail magazine A from the electric screwdriver and then detach the parts of the screw nail magazine A so that the lock screw A72 can be fastened to the stop block A71 again. After the lock screw A72 and the stop block A71 have been connected together, the user must install the movable holder member A2, the belt track A5 and the spring member A3 in the fixed holder member A1 in proper order again. This procedure is complicated, wasting much time. Further, it is also complicated to adjust the position of the stop block A71, increasing the user's work time.

SUMMARY OF THE INVENTION

The present invention has been accomplished under the circumstances in view. It is therefore one object of the present invention to provide a screw nail magazine for an electric screwdriver, which allows fast adjustment of the nailing depth.

To achieve this object of the present invention, the screw nail magazine comprises a fixed holder member having a receiving chamber and an elongated slot in communication with the receiving chamber, a movable holder member reciprocally moveably received in the receiving chamber; and a positioning member fixedly mounted on the movable holder member for reciprocating motion with the movable holder member. The positioning member has a first end extending out of the fixed holder member and having a contact portion for stopping against a surface where a screw nail is to be driven in or driven out, and a second end disposed inside the fixed holder member and provided with a stop face. A nailing depth adjustment device for controlling the nailing depth of the screw nail to be driven into the surface comprises a control member, a driven member, a slider and a stop block. The control member has a shank pivotally inserted through the fixed holder member with an end thereof located inside the receiving chamber, and a knob fixedly connected to the other end of the shank and exposed outside the fixed holder member. The driven member is fixedly connected with the end of the shank that is located inside the receiving chamber so that the driven member is pivotable when the knob of the control member is pivoted relative to the fixed holder member. The driven member is provided with a coupling groove. The slider is coupled to the coupling groove of the driven member and inserted through the elongated slot of the fixed holder member and movable along the elongated slot of the fixed holder member by the movement of the driven member when the driven member is pivoted along with the knob. The stop block is connected to the slider and located inside the receiving chamber. The stop block has a stop face complementarily stopped at the stop face of the positioning member for limiting the reciprocal stroke of the moveable holder member in the fixed holder member so as to control the nailing depth of the screw nail.

DETAILED DESCRIPTION OF THE INVENTION

Figure 1:
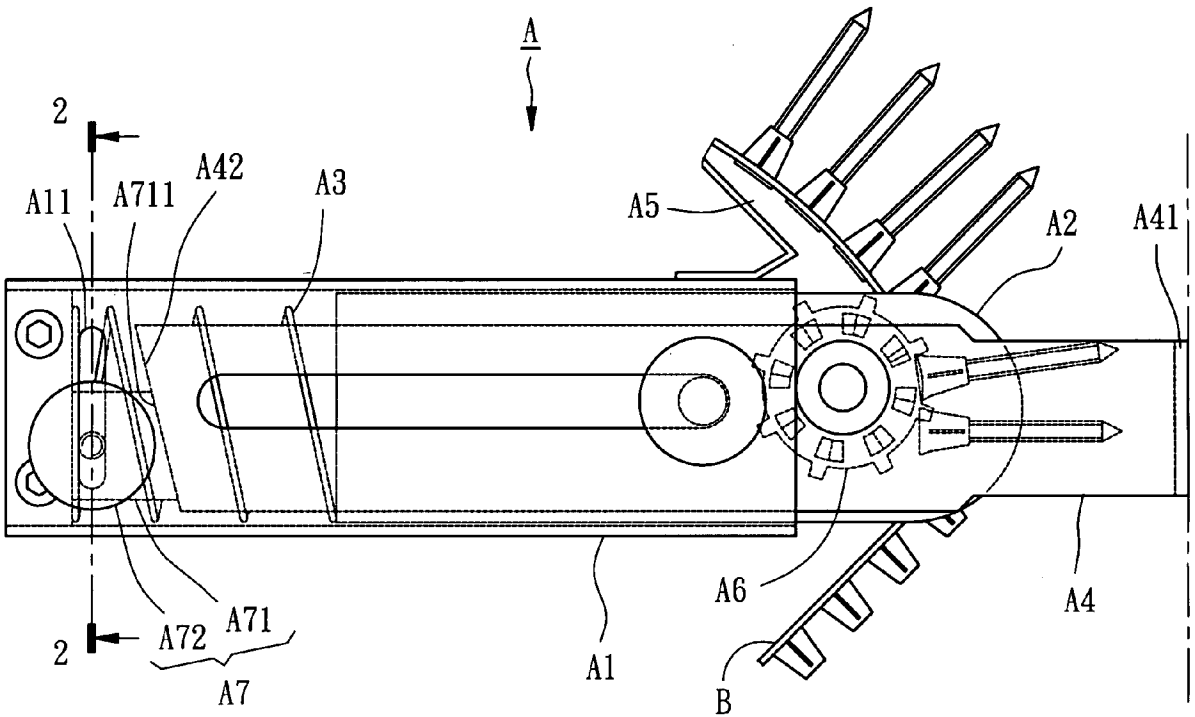
FIG. 1 PRIOR ART
FIG. 1 is a schematic drawing showing a screw nail magazine for an electric screwdriver according to the prior art.
Figure 2:
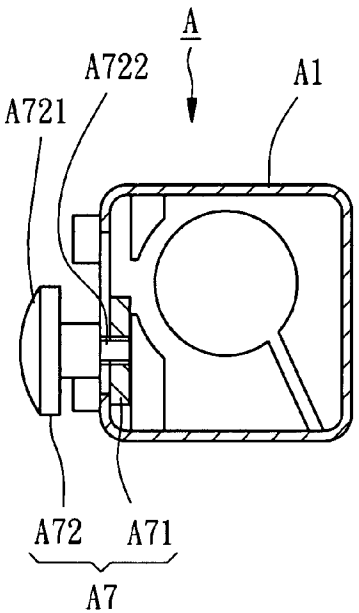
FIG. 2 PRIOR ART
FIG. 2 is a sectional view taken along line 2-2 of FIG. 1.
Figure 3:
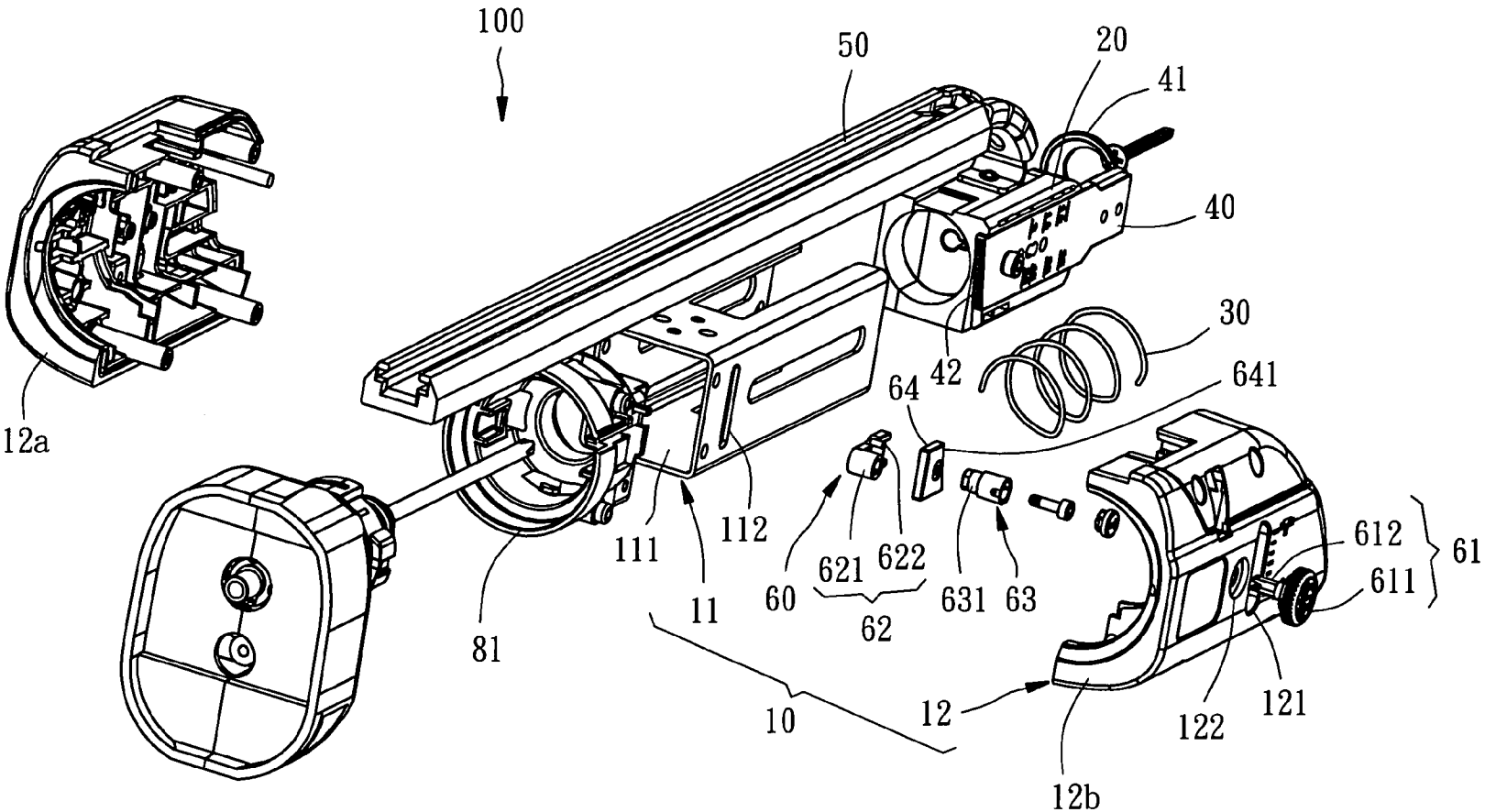
FIG. 3 is an exploded view of a screw nail magazine for an electric screwdriver according to a preferred embodiment of the present invention.
Figure 4:
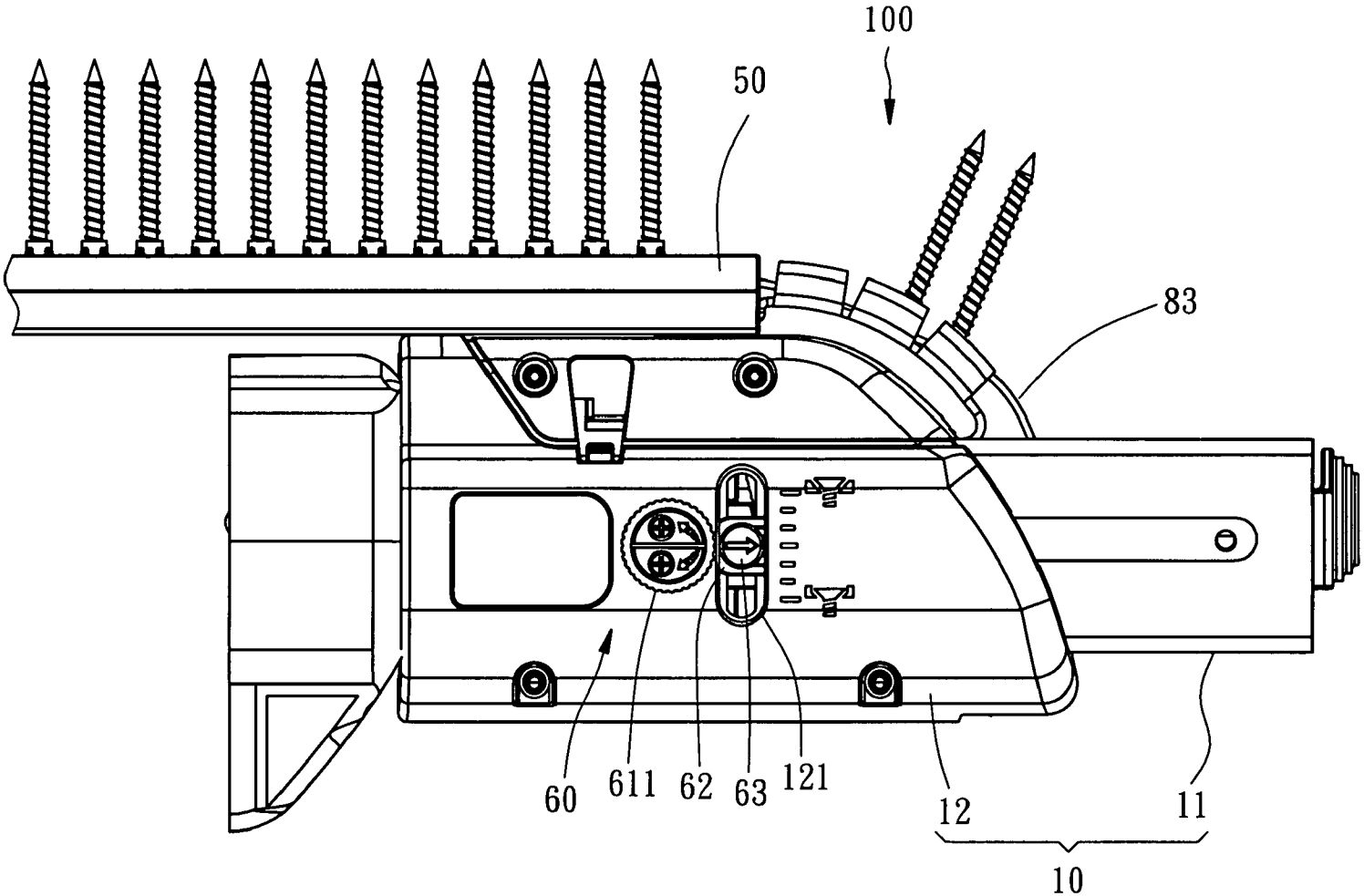
FIG. 4 is a side view of the screw nail magazine according to the preferred embodiment of the present invention.
Figure 5:
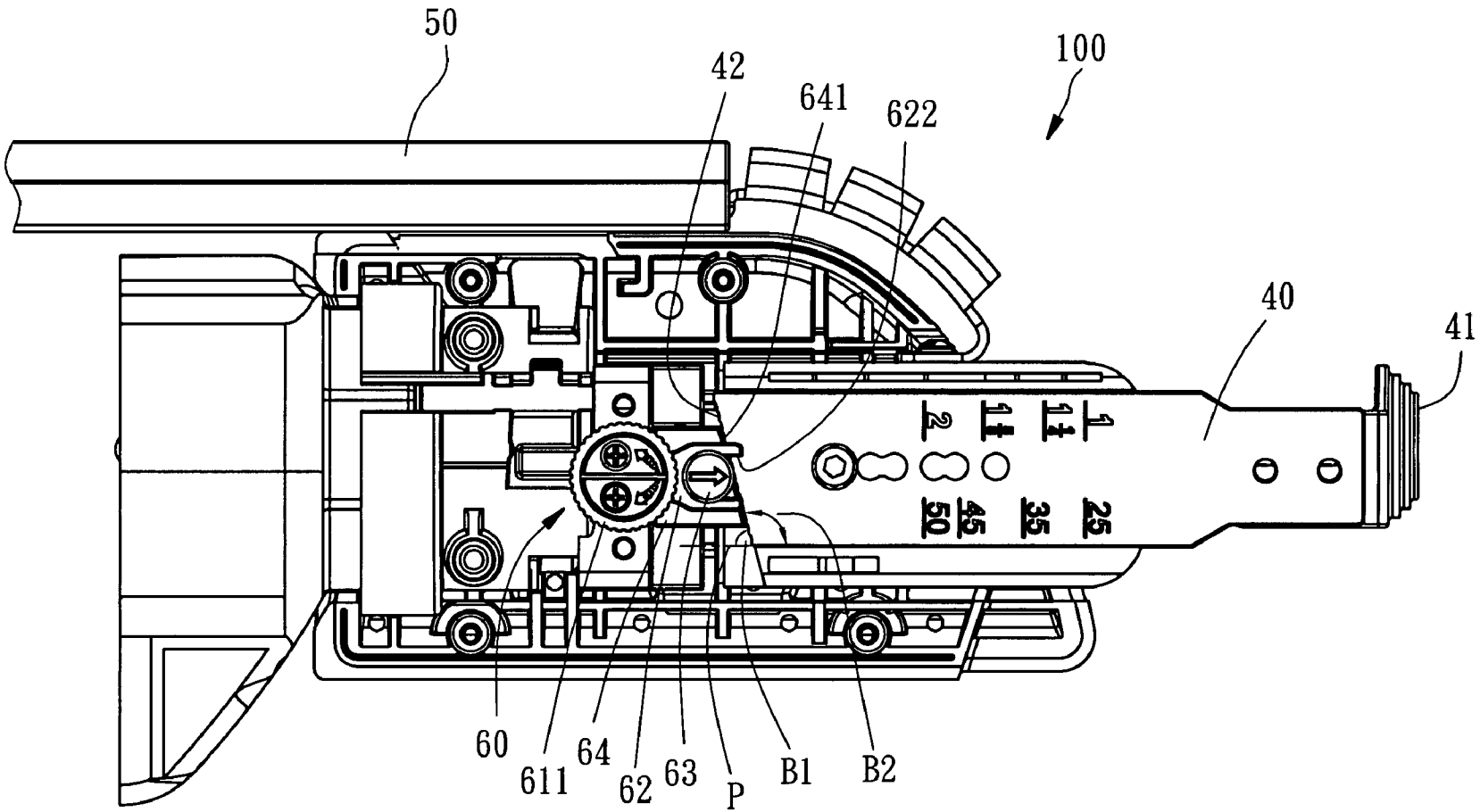
FIG. 5 is a sectional view of the screw nail magazine under the status shown in FIG. 4.
Figure 6:
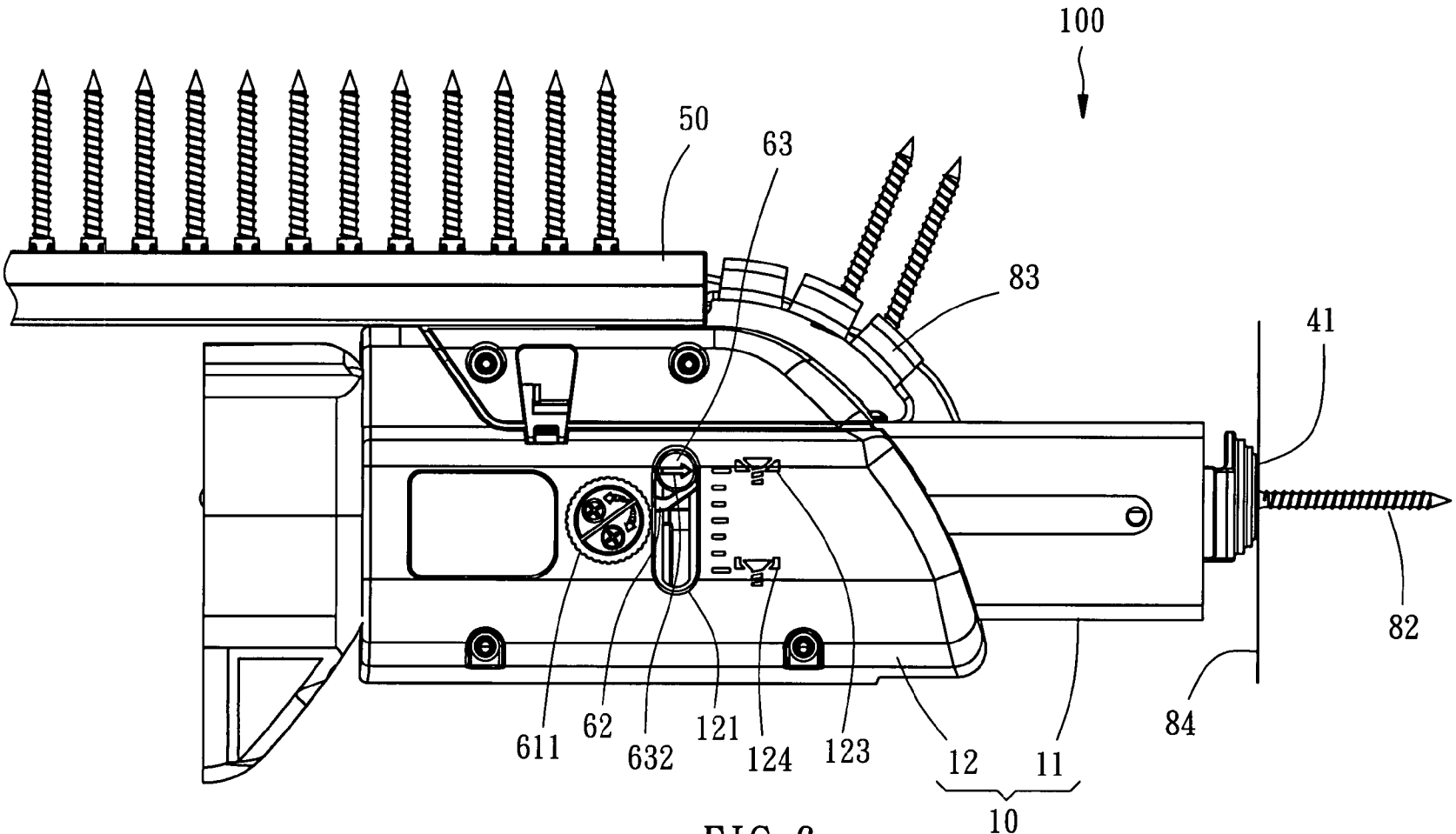
FIG. 6 is similar to FIG. 4, but showing a different operation status of the screw nail magazine.
Figure 7:
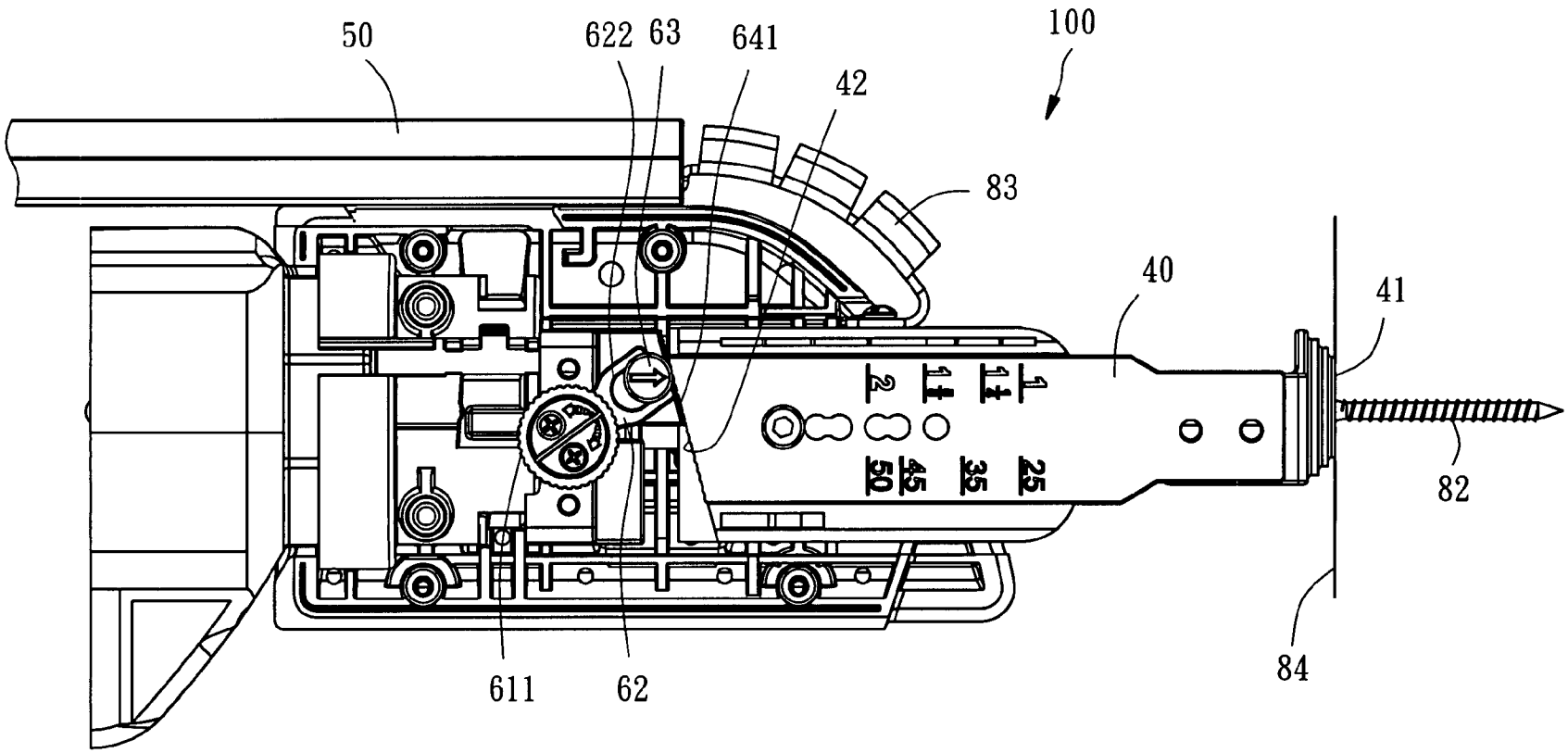
FIG. 7 is similar to FIG. 5, but showing the operation status of the screw nail magazine of FIG. 6.

As shown in FIGS. 3-5, a screw nail magazine 100 in accordance with the preferred embodiment of the present invention comprises a fixed holder member 10, a movable holder member 20, a spring member 30, a positioning member 40, a belt track 50, a belt drive member (not shown), and a nailing depth adjustment device 60.

The fixed holder member 10 is directly affixed to an electric screwdriver (not shown). Alternatively, the fixed holder member 10 can be fastened to an electric screwdriver by a quick release connector 81. The fixed holder member 10 comprises an inner frame base 11 and a cover shell 12. The inner frame base 11 defines an inside receiving chamber 111 and has an elongated slot 112 formed on the peripheral wall in communication with the inside receiving chamber 111. The cover shell 12 is comprised of a left shell element 12*a*and a right shell element 12*b*that are abutted against each other and covered on the inner frame base 11. The right shell element 12*b*has an elongated slot 121 corresponding in location to the elongated slot 112 on the inner frame base 11, and a through hole 122 near one side of the elongated slot 121.

The movable holder member 20 is set in the receiving chamber 111 inside the fixed holder member 10 and reciprocally moveable along the receiving chamber 111.

The spring member 30 is provided between the fixed holder member 10 and the movable holder member 20.

The positioning member 40 is fixedly mounted on the movable holder member 20 for reciprocating motion with the movable holder member 20. The positioning member 40 has one end extending out of the fixed holder member 10 and having a contact portion 41 for stopping against the work surface where a screw nail is to be driven in and out. The other end of the positioning member 40 is disposed inside the fixed holder member 10 and provided with a stop face 42. The stop face 42 defines with a direction of the moving path P of the movable holder member 20 an included angle B1. This included angle B1 can be greater than 0° but smaller than 90°. Alternatively, this included angle B1 can be greater than 90° but smaller than 180°. According to this embodiment, the included angle B1 is about 85°, as shown in FIG. 5.

The belt track 50 is mounted on the movable holder member 20 for supporting a belt 83 of screw nails 82 (see FIG. 4) and providing a moving path for the belt 83 of screw nails 82.

The belt drive member (not shown) is mounted in the movable holder member 20 and adapted to move the belt 83 of screw nails 82 along the path provided by the belt track 50.

The nailing depth adjustment device 60 comprises a control member 61, a driven member 62, a slider 63, and a stop block 64.

The control member 61 comprises a knob 611 and a shank 612 connected to the knob 611. The shank 612 is pivotally inserted through the through hole 122 into the inside of the cover shell 12 such that the control member 61 is pivotally connected to the cover shell 12 of the fixed holder member 10 with the knob 611 exposed outside the cover shell 12. The driven member 62 has a connection hole 621 at one side and a coupling groove 622 at the other side. The shank 612 of the control member 61 is fixedly engaged in the connection hole 621 of the driven member 62. Therefore, when the knob 611 is rotated it will drive the driven member 62 to rotate with the shank 612. The slider 63 is a rod member has a neck 631 coupled to the coupling groove 622 of the driven member 62, one end, namely, the inner end inserted through the elongated slot 112 into the inside of the receiving chamber 111, and the other end, namely, the outer end positioned in the elongated slot 121 of the cover shell 12. The stop block 64 is connected to the inner end of the slider 63 and suspends inside the receiving chamber 111. The stop block 64 has a stop face 641 that defines with the direction of the moving path P of the movable holder member 20 an included angle B2 which is in a complementary manner relative to the included angle B1.

Figure 8:
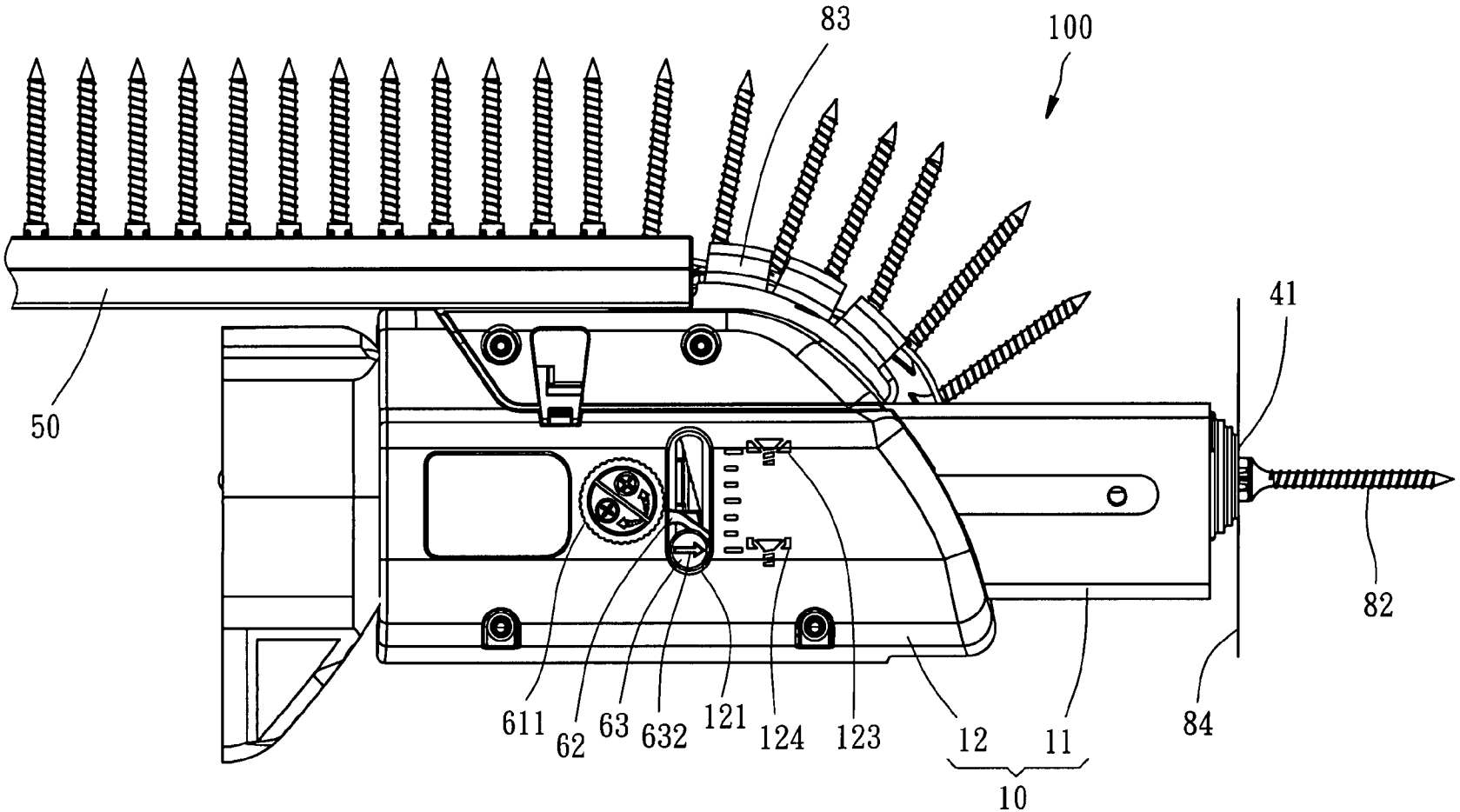
FIG. 8 is similar to FIG. 4, but showing another different operation status of the screw nail magazine.
Figure 9:
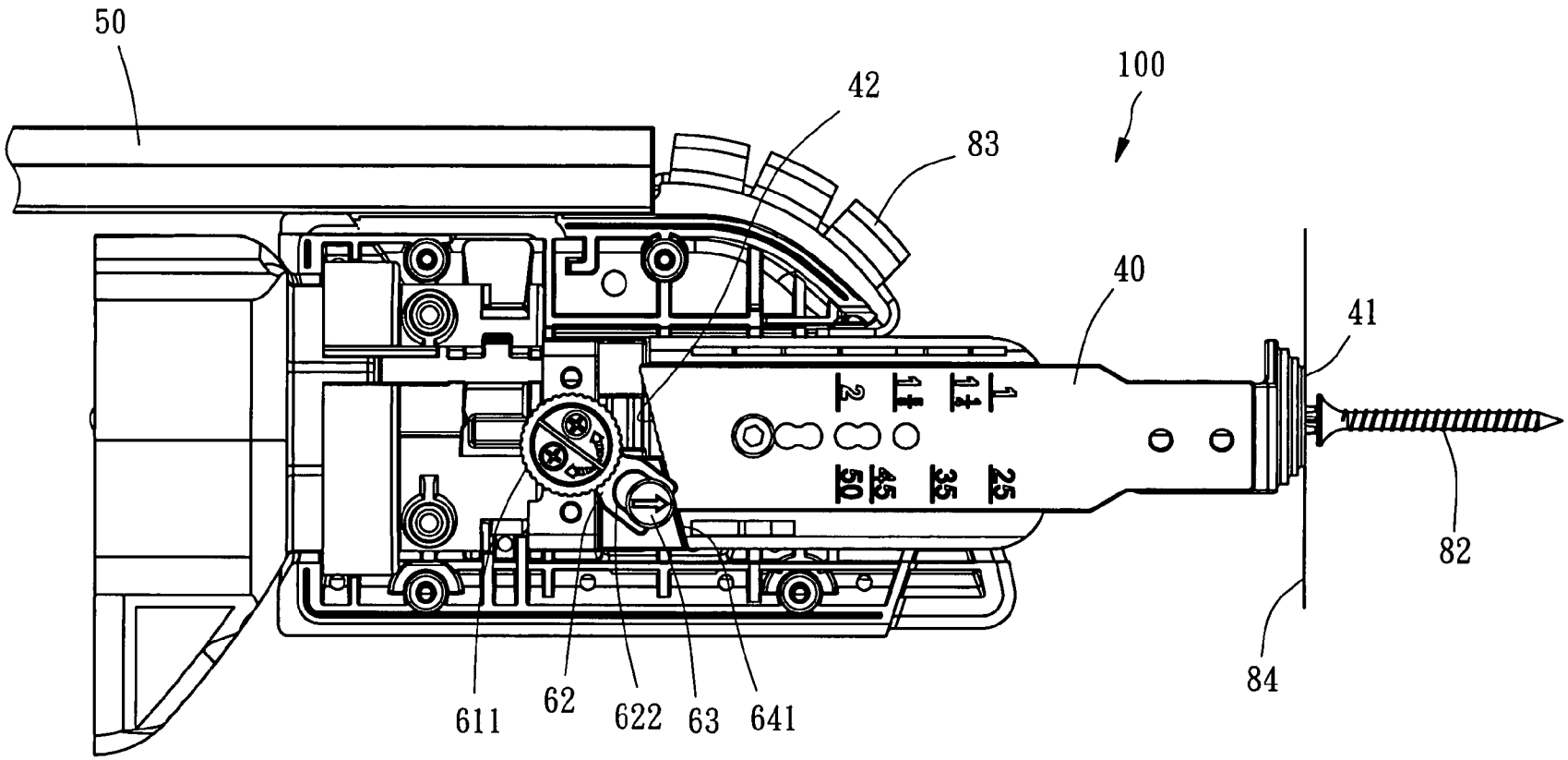
FIG. 9 is similar to FIG. 5, but showing the operation status of the screw nail magazine of FIG. 8.

The use of the screw nail magazine is outlined hereinafter with reference to FIGS. 6-9. Before nailing one screw nail 82 into the work surface 84, the user can rotate the knob 611 to bias the driven member 62 and to further move the slider 63 along the elongated slot 112 of the inner frame base 11 of the fixed holder member 10, thereby changing the position of the stop block 64 in the receiving chamber 111 subject to the desired nailing depth (see FIGS. 6 and 7). When the arrowhead index 632 at the slider 63 is moved toward the first indication area 123 at the cover shell 12, the stop block 64 is in a relatively higher position in the elongated slot 112, and the stop face 42 of the positioning member 40 is stopped at the stop face 641 of the stop block 64 in the receiving chamber 111 near the outer open side of the fixed holder member 10. At this time, the depth in which the movable holder member 20 and the positioning member 40 entered the receiving chamber 111 is relatively shallower. This means that the nailing depth of the screw nail is relatively shorter. On the contrary, when the arrowhead index 632 at the slider 63 is moved toward the second indication sign 124 at the cover shell 12 opposite to the first indication sigh 123, as shown in FIGS. 8 and 9, the stop block 64 is in a relatively lower position in the elongated slot 112, and the stop face 42 of the positioning member 40 is stopped at the stop face 641 of the stop block 64 in the receiving chamber 111 far from the outer open side of the fixed holder member 10. At this time, the depth in which the movable holder member 20 and the positioning member 40 entered the receiving chamber 111 is relatively deeper, and the screw nail 82 can be driven into the work surface 84 relatively deeper.

As indicated above, by means of rotating the knob 611 the nailing depth of the screw nail to be driven into the working surface can be easily adjusted. Further, the shank 612 of the control member 61 is fixedly connected to the driven member 62, thereby preventing the control member 61 from escaping from the screw nail magazine when adjusting the nailing depth of the screw nail that is to be driven into the working surface. This feature avoids the forementioned disadvantage of the conventional screw nail magazine. In conclusion, the screw nail magazine provided by the present invention for an electric screwdriver functions smoothly to provide all of the features discussed earlier.

What is claimed is:

1. A screw nail magazine comprising:

a fixed holder member having a receiving chamber and an elongated slot in communication with said receiving chamber;

a movable holder member reciprocally moveably received in said receiving chamber;

a positioning member fixedly mounted on said movable holder member for reciprocating motion with said movable holder member, said positioning member having a first end extending out of said fixed holder member and having a contact portion for stopping against a surface where a screw nail is to be driven in or driven out, and a second end disposed inside said fixed holder member and provided with a stop face which defines with a direction of a moving path of said movable holder member a first included angle that is greater than 0° but smaller than 90° or greater than 90° but smaller than 180°;

a belt track mounted on said movable holder member for supporting a belt of screw nails and providing a moving path for the belt of screw nails;

a belt drive member mounted in said movable holder member for moving the belt of screw nails along the moving path provided by said belt track; and a nailing depth adjustment device for controlling the nailing depth of the screw nail to be driven into the surface; wherein said nailing depth adjustment device comprises:

a control member having a shank pivotally inserted through said fixed holder member with an end thereof located inside said receiving chamber, and a knob fixedly connected to the other end of said shank and exposed outside said fixed holder member;

a driven member fixedly connected with the end of said shank that is located inside said receiving chamber so that the driven member is pivotable when the knob of said control member is pivoted relative to said fixed holder member, said driven member being provided with a coupling groove;

a slider coupled to the coupling groove of said driven member and inserted through the elongated slot of said fixed holder member and movable along the elongated slot of said fixed holder member by the movement of said driven member when the driven member is pivoted along with said knob; and a stop block connected to said slider and located inside said receiving chamber, said stop block having a stop face stopped at the stop face of said positioning member, the stop face of said stop block defining with the direction of the moving path of said movable holder member a second included angle which is complementary to said first included angle.

2. The screw nail magazine as claimed in claim 1, wherein said slider has a neck coupled to the coupling groove of said driven member.

* * * * *